United States Patent [19]

Grothe

[11] Patent Number: 4,511,892

[45] Date of Patent: Apr. 16, 1985

[54] VARIABLE REFRESH RATE FOR STROKE CRT DISPLAYS

[75] Inventor: Steven P. Grothe, Glendale, Ariz.

[73] Assignee: Sperry Corporation, New York, N.Y.

[21] Appl. No.: 392,206

[22] Filed: Jun. 25, 1982

[51] Int. Cl.[3] ..... G09G 1/04

[52] U.S. Cl. ..... 340/739; 340/736; 340/721; 340/732

[58] Field of Search ..... 340/736, 739, 740, 741, 340/743, 751, 789, 721, 745, 737, 738, 732; 364/521

[56] References Cited

U.S. PATENT DOCUMENTS

| | | | |
|---|---|---|---|
| 3,047,851 | 7/1962 | Palmiter | 340/739 |
| 3,090,041 | 5/1963 | Dell | 340/739 |
| 3,434,135 | 3/1969 | Granberg et al. | 340/739 |
| 3,706,906 | 12/1972 | Koussa et al. | 340/736 |
| 4,001,806 | 1/1977 | Sweeting | 340/739 |
| 4,032,768 | 6/1977 | Rieger | 340/739 |
| 4,074,359 | 2/1978 | Hasenbalg | 340/739 |
| 4,365,305 | 12/1982 | MacDonald et al. | 340/739 |

*Primary Examiner*—Gerald L. Brigance
*Attorney, Agent, or Firm*—Howard P. Terry

[57] ABSTRACT

In a cathode ray tube display system of the type utilizing stroke techniques, the display refresh rate is allowed to decrease from a specified maximum in order to ensure that all stroke information is displayed. When the cathode ray tube display system further includes a raster symbol generator, the display refresh rate varies as a function of a fixed raster time interval and a variable stroke time interval.

6 Claims, 9 Drawing Figures

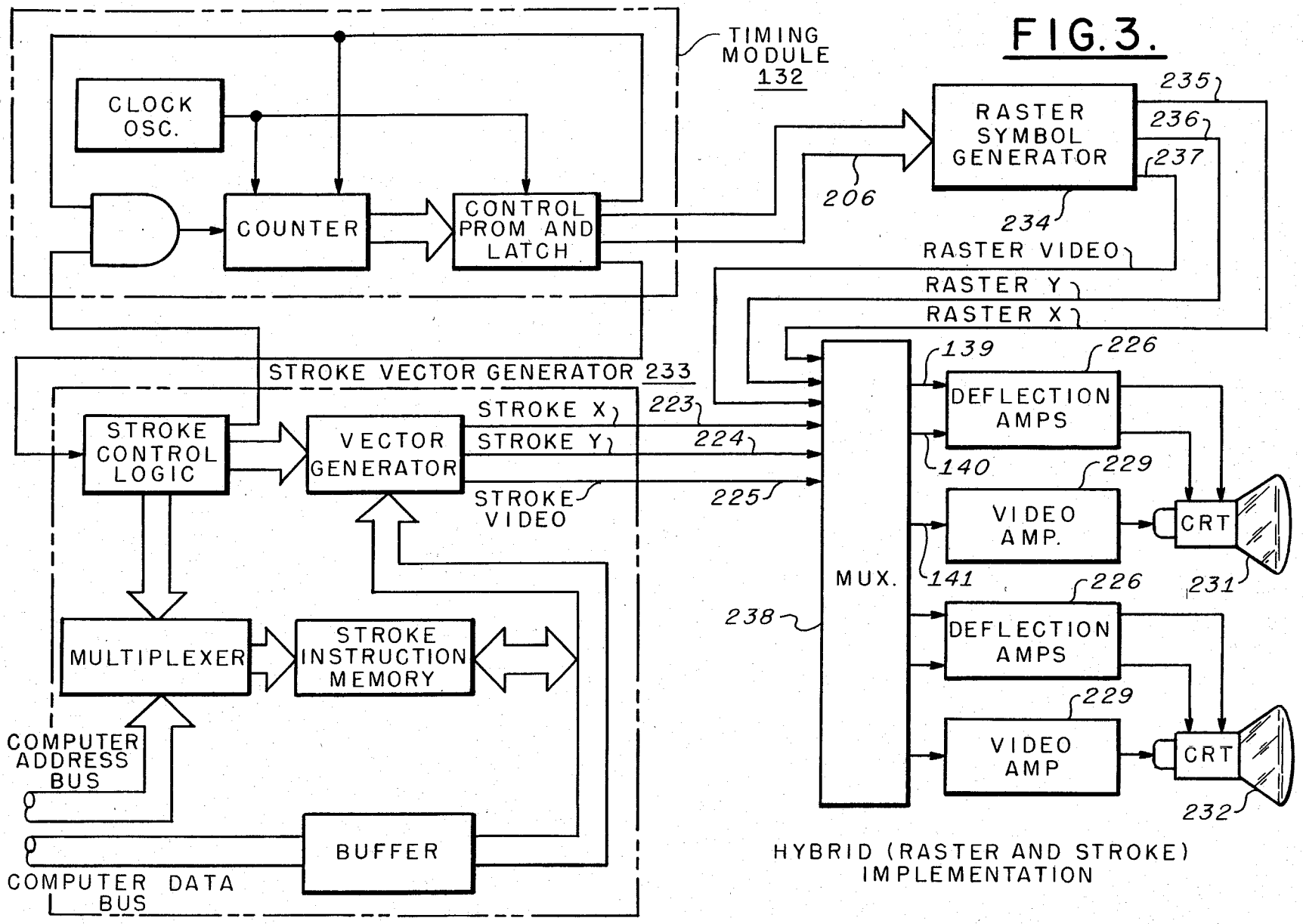
FIG. 3.
RASTER SYMBOL GENERATOR
234
235
236
237
206
RASTER VIDEO
RASTER Y
RASTER X
226
DEFLECTION AMPS
229
VIDEO AMP.
CRT
231
226
DEFLECTION AMPS
229
VIDEO AMP
CRT
232
139
140
141
MUX.
238
HYBRID (RASTER AND STROKE) IMPLEMENTATION
TIMING MODULE 132
CONTROL PROM AND LATCH
COUNTER
CLOCK OSC.
STROKE VECTOR GENERATOR 233
223
224
225
STROKE X
STROKE Y
STROKE VIDEO
VECTOR GENERATOR
STROKE CONTROL LOGIC
STROKE INSTRUCTION MEMORY
MULTIPLEXER
BUFFER
COMPUTER ADDRESS BUS
COMPUTER DATA BUS

MAXIMUM REFRESH RATE
FOR HYBRID DISPLAY.
NO EXTENSION REQUIRED

LOWER REFRESH RATE. REFRESH TIME IS
EXTENDED AS THE AMOUNT OF STROKE
INFORMATION INCREASES.

MAXIMUM REFRESH RATE FOR DUAL DISPLAY. NO EXTENSION REQUIRED

LOWER REFRESH RATE. REFRESH TIME IS EXTENDED AS THE AMOUNT OF STROKE INFORMATION INCREASES.

VARIABLE REFRESH RATE FOR STROKE CRT DISPLAYS

BACKGROUND OF THE INVENTION

1. Field of the Invention

The invention relates to synthetically generated displays and particularly to cathode ray tube displays utilizing stroke (caligraphic) techniques.

2. Description of the Prior Art

Stroke written CRT displays involve deflecting the electron beam in a manner so as to actually "draw" the shape of figures to be presented. This differs from a raster type system in which the beam traces an unchanging pattern of scan lines and information is presented by illuminating the beam at the appropriate points along each line. Inherent to raster systems is a display refresh rate that is independent of the amount of information to be presented. In a stroke system the time required to present all the information is directly proportional to the amount of information.

Refresh rate is defined as the number of times per second a display format is presented for viewing. A sufficiently high refresh rate is desirable to avoid effects such as flicker. When a fixed refresh rate is used, this implies a fixed time interval in which all information may be presented. If more information is required than can be written in the fixed interval at a given writing speed, the additional information could be truncated from the display. In many applications, and significantly in the case of aircraft flight instruments, loss of such information is unacceptable.

Increasing the stroke writing speed is a method which has been used to increase the amount of information which can be displayed in a given time interval. This method has several disadvantages. First, CRT display deflection bandwidth can be exceeded by increasing writing speed. This can result in severe degradation of quality and integrity of the displayed information. Also, in environments where power dissipation is critical, higher writing speed can result in an unacceptable increase in deflection power.

SUMMARY OF THE INVENTION

The present invention provides a solution to the above described problem by providing a fundamental minimum display time interval which can be extended indefinitely to insure no display information is lost.

Overall control of the display is accomplished with a timing module. At the beginning of a display refresh cycle a counter within the timing module is reset and the counter begins sequencing at a rate determined by a clock oscillator. The counter provides sequencing inputs to a control PROM and latch. The control PROM and latch generate control signals as may be required for the particular system. A signal is generated which indicates to a stroke vector generator that it is to begin its display generation process. The stroke vector generator produces horizontal and vertical deflection waveforms and video (or color) control which are used by the CRT to produce a picture.

When a predetermined minimum refresh time interval has been completed, the control PROM and latch in the timing module send a signal which stops the operation of the counter, which is waiting for an indication from the stroke vector generator that its display is complete. When the stroke vector generator has completed drawing the display picture it produces a signal which indicates to the timing module that the update is finished. The timing module will not begin a new refresh cycle until both the minimum refresh interval is met and the stroke vector generator has finished a complete display update. In this manner the refresh rate of the display is held to a maximum but is allowed to lessen indefinitely as may be necessary to display all picture information.

BRIEF DESCRIPTION OF THE DRAWINGS

FIG. 2 and 3 are block diagrams of cathode ray tube display systems utilizing both stroke and raster techniques and the apparatus of the present invention.

DESCRIPTION OF THE PREFERRED EMBODIMENT

Figure 1:
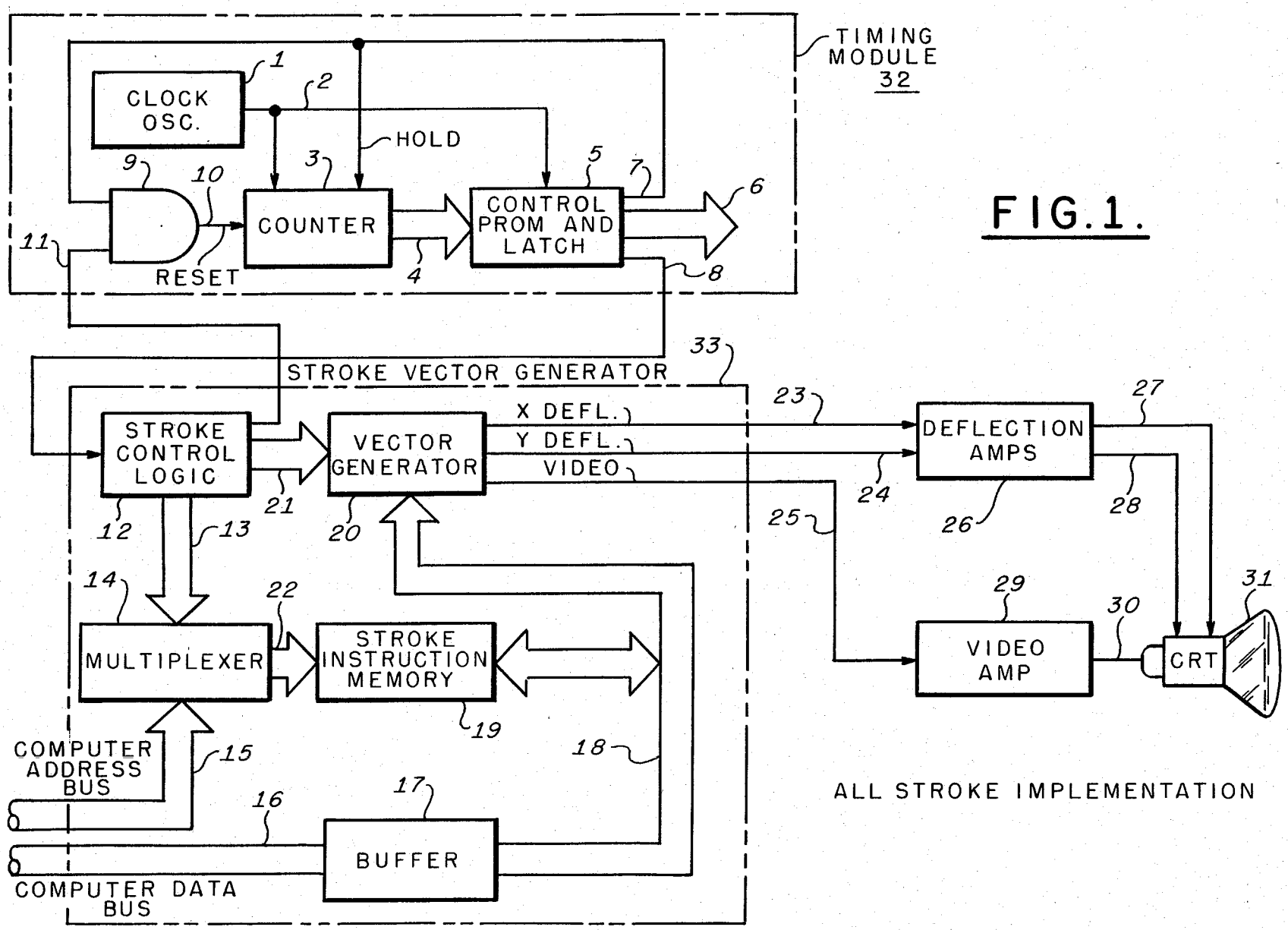
FIG. 1 is a block diagram of a cathode ray tube display system utilizing stroke techniques and the apparatus of the present invention.

Referring now to FIG. 1, a variable refresh rate with a predetermined maximum and capability for indefinite refresh interval extension may be accomplished by utilizing two-way communication between a timing module 32 and a conventional stroke vector generator 33.

The timing module 32 is operated based on regular clock pulses generated by a clock oscillator 1. The frequency of the clock oscillator is determined by the resolution (in time) of required control signals 6 to be generated for a particular system. The clock pulses are sent to a counter 3 and a control PROM (Programmable Read Only Memory) and latch 5 to effect a controller function. The counter 3 has a sufficient number of stages to provide adequate time range for the control signals 6, 7, 8 as required by the system for the given clock oscillator 1 frequency. The counter 3 produces a binary count sequence which addresses the control PROM 5. The control PROM 5 is programmed such that as the count sequence 4 progresses the control signals 6, 7, 8 are generated in the appropriate order and time. One control signal 8 is sent to the stroke vector generator 33 to indicate it is to begin generation of the display format. A maximum limit for the refresh rate involves allowing a certain minimum interval for display update. When the minimum interval is met the control PROM 5 sets a signal line 7 high. This provides an enable to the counter reset 10 function which will be activated through an AND gate 9 when the stroke vector generator 33 has finished the display update and so indicates by setting the signal line 11 high. This same signal 7 freezes the counter 3 so no additional control activity will occur until the stroke vector generator 33 has finished.

The stroke vector generator 33 produces horizontal 23 and vertical 24 deflection waveforms and video (or color) control 25 as directed by instructions stored in a read/write stroke instruction memory 19. The computer stores the instructions by gaining access to the memory 19 with a computer address bus 15 and a data bus 16 via an address multiplexer 14 and a data buffer 17. Instructions are stored sequentially and completely define the picture to be presented. The last instruction in the memory will indicate that the display is complete.

When the signal line 8 from the timing module 32 goes high the stroke control logic gains access to the stroke instruction memory 19 and begins the display update. Via control lines 21 to the vector generator 20, the stroke control logic 12 loads instructions through the instruction bus 18. A vector generator 20 uses these instructions to generate the necessary deflection 23, 24 and video 25 to present a display. When the last instruction has been loaded from the stroke instruction memory 19 a signal line 11 is set high indicating that the stroke vector generator 33 is finished with the display update.

When the stroke vector generator 33 is finished as indicated by a signal on line 11, and the minimum refresh interval is met, as indicated by a signal on line 7, the AND gate 9 produces the reset signal 10 which restarts the counter 3. Thus a new refresh cycle is begun. Vertical and horizontal deflection amplifiers 26 and a video amplifier 29 are used to produce electrical levels for signals 27, 28, 30, required to operate a CRT (cathode ray tube) display 31.

Figure 4A:
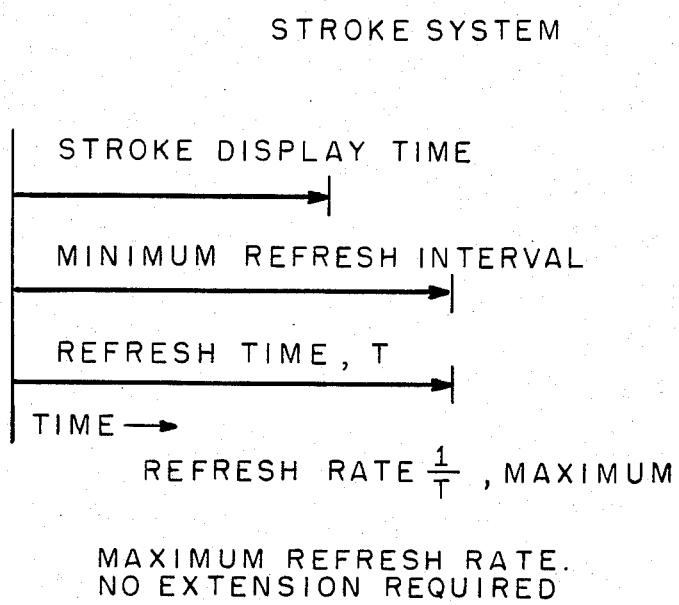
FIGS. 4*a*, 4*b*, 5*a*, 5*b*, 6*a*, and 6*b* are timing diagrams useful in explaining the operation of the present invention.
Figure 4B:
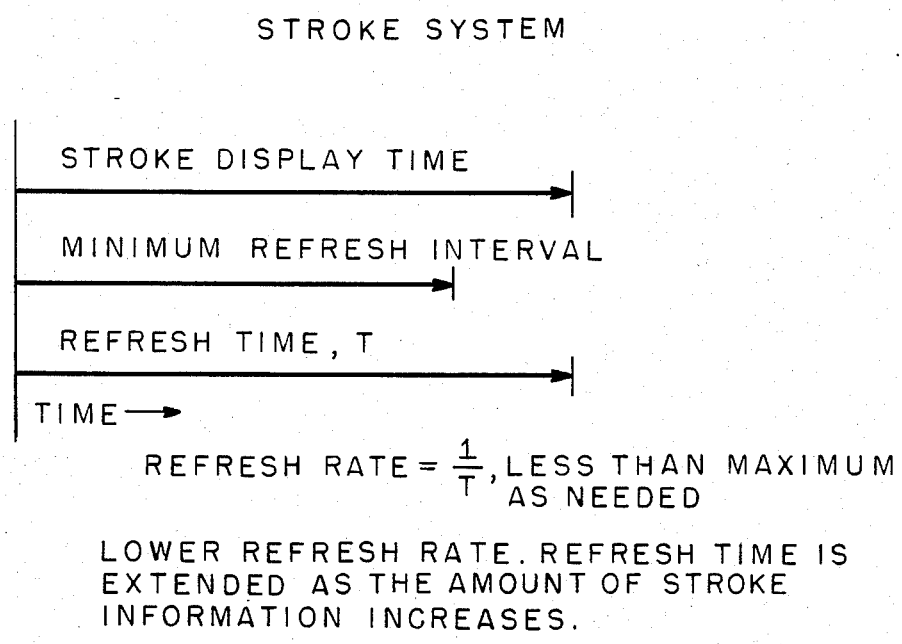

Referring now to FIGS. 4*a* and 4*b*, the operation of the apparatus of FIG. 1 may be more fully appreciated. When the stroke display time is less than the minimum refresh interval as in FIG. 4*a*, there is no need to extend the refresh rate. It should be noted that refresh rate is inversely proportional to the refresh time T and consequently as the refresh time T increases, the refresh rate decreases. In FIG. 4*b* when the stroke display time exceeds the minimum refresh interval, the refresh time T is extended with an attendant decrease in the refresh rate.

Figure 2:
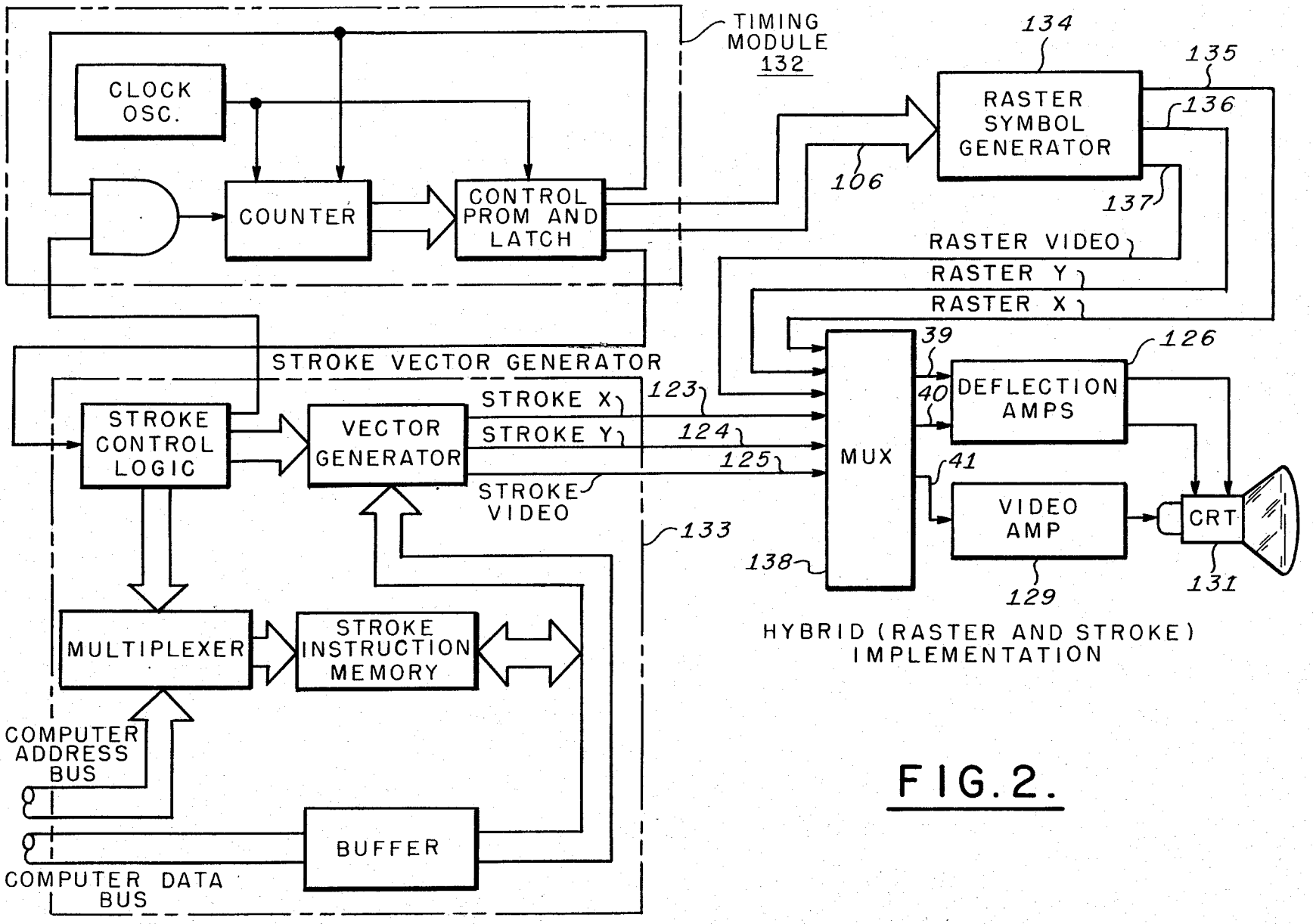

Referring now to FIGS. 2 and 3, alternate embodiments of the present invention may be utilized in either a hybrid display system or a dual display system, which are depicted by the block diagrams of FIGS. 2 and 3, respectively. A hybrid display system includes a conventional stroke vector generator 133 and a conventional raster symbol generator 134 which supply alternately and sequentially a single CRT 131 with a picture that includes both raster and stroke information. A dual display system includes a conventional stroke vector generator 233 and a conventional raster symbol generator 234 which concurrently supply a first CRT 231 with raster information while supplying a second CRT 232 with stroke information and vice versa. In effect, with essentially the same hardware the dual display system permits time shared raster and stroke information to be displayed on two CRT's 231, 232 while the hybrid display system permits raster and stroke information to be displayed only on a single CRT 131.

The raster symbol generators 134, 234 may be of a type described in U.S. Pat. No. 4,070,662 "Digital Raster Display Generator for Moving Displays", issued Jan. 24, 1978 and assigned to the Applicant's assignee. The outputs of the stroke vector generator 133 and the raster symbol generator 134 are supplied to the CRT 131 in a hybrid system via a multiplexer 138 and associated deflection amplifier 126 and video amplifier 129. In a dual system the output of the stroke generator 233 and the raster generator 234 are supplied to the CRTs 231, 232 via a multiplexer 238 and associated deflection amplifiers 226 and video amplifiers 229.

In a hybrid system, at the start of a refresh cycle the timing module 132 produces control signals 106 which direct the generation of raster deflection and video signals 135, 136, 137. The raster waveforms are selected via the multiplexer 138 to drive the CRT display 131. After the raster interval is complete, the timing module 132 indicates to the stroke vector generator 133 that it is to begin its display generation. The resulting stroke deflection and video waveforms 123, 124, 125 are directed via the multiplexer 138 to the CRT display 131. After the start of the stroke vector generator 133 operation, the same procedures are followed as for the "all stroke"system of FIG. 1 described above.

Figure 5A:
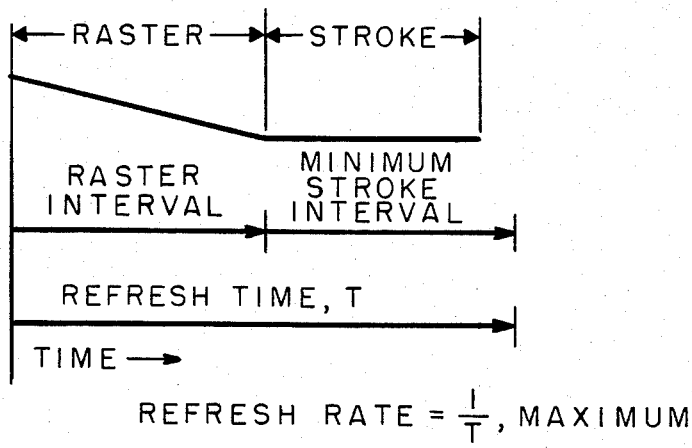
Figure 5B:
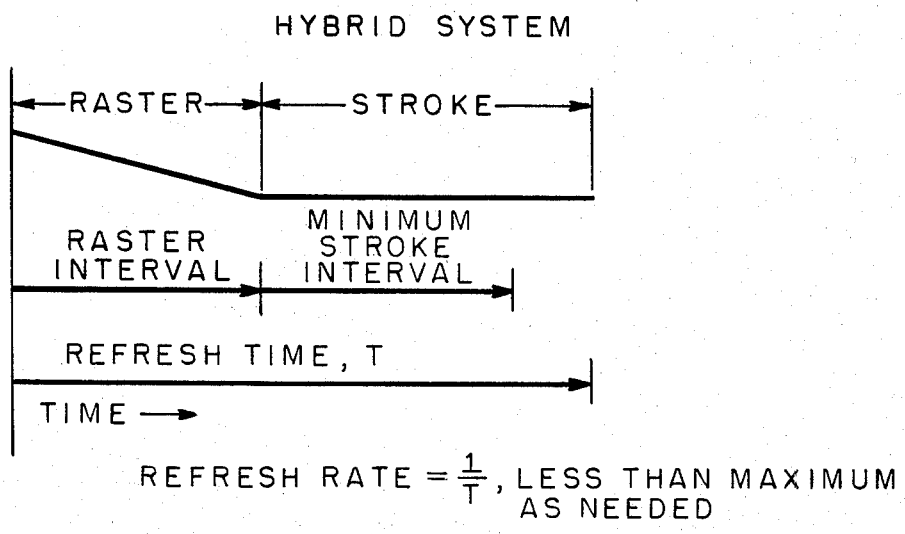

The operation of the hybrid display system may be more fully appreciated by referring to FIGS. 5*a* and 5*b*. The raster interval is a fixed period of time and a minimum stroke interval is established. When the stroke information to be displayed requires less time than the minimum stroke interval, then the refresh time, T, is equal to the fixed raster interval and the minimum stroke interval and the refresh rate is at a maximum as in FIG. 5*a*. When the stroke information to be displayed requires more time than the minimum stroke interval, then the refresh time is extended in order to display all the stroke information and the refresh rate decreases as in FIG. 5*b*.

Figure 6A:
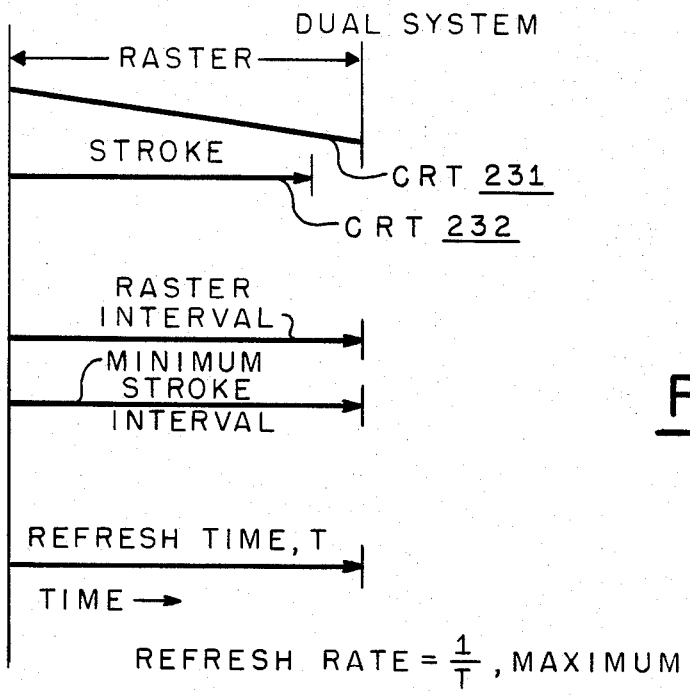
Figure 6B:
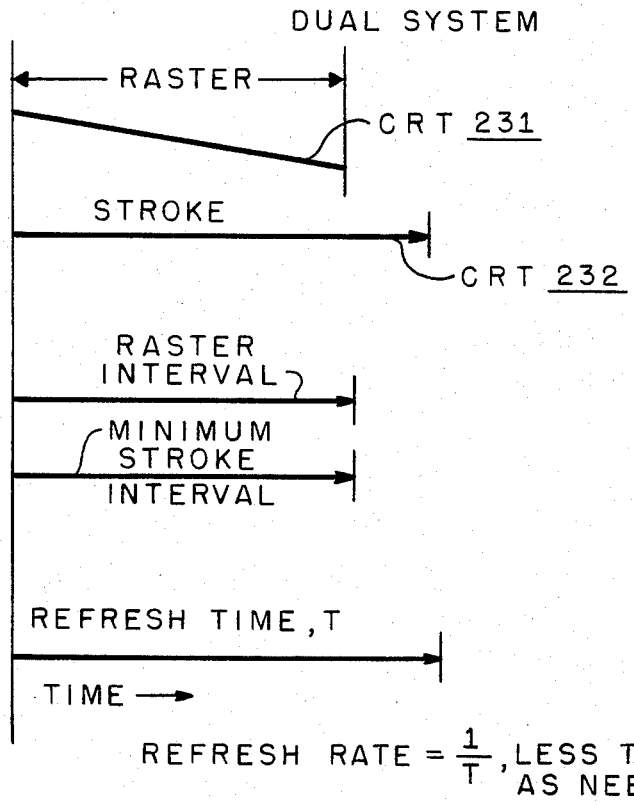

The operation of a dual system as depicted in FIGS. 6*a* and 6*b* is somewhat similar to that of the hybrid system. The major differences, however, between the dual and hybrid systems are the inclusion of a second CRT 232 and the ability to display simultaneously on CRTs 231 and 232 both stroke and raster information. This simultaneous display of pictures on CRTs 231, 232 results from the time shared manipulation of information provided by the stroke vector generator 233 and the raster symbol generator 234. In FIG. 6*a*, for example, it can be appreciated that as raster information is being displayed on CRT 231 stroke information is being displayed on CRT 232. Since in FIG. 6*a* the time necessary to display the stroke information on CRT 232 is less than the minimum stroke interval, there is no extension of the refresh time and the refresh rate is at a maximum. If, however, as in FIG. 6*b* the stroke interval for CRT 232 exceeds the raster interval for CRT 231, then the refresh time T is extended with an attendant decrease in refresh rate for both CRTs 231 and 232.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. In a display system of the type having a stroke vector display generator means for supplying stroke information to at least one cathode ray tube, wherein the improvement comprises:

means for providing signals representative of minimum refresh intervals for said stroke information to be displayed on said at least one cathode ray tube;

means cupled to said stroke vector display generator means for initiating said stroke information and for providing signals representative of completions of said stroke information; and means coupled to said minimum signal means and said stroke initiation and completion signal means for recycling said display system when a minimum stroke refresh representative signal and a stroke completion representative signal are received, thereby extending refresh intervals for said stroke information for a time necessary to display said stroke information.

2. A display system according to claim 1 which further includes:

raster symbol generator means for supplying raster information;

means for establishing a fixed refresh interval for said raster information to be displayed on said at least one cathode ray tube;

means coupled to said raster symbol generator means and said vector symbol generator means for alternately providing raster information and vector information to said at least one cathode ray tube whereby said refresh rate for said at least one cathode ray tube is a function of said fixed raster interval and said time necessary to display said stroke information.

3. A display system according to claim 1 wherein said minimum refresh interval means and said recycling means include:

a clock oscillator;

counting means coupled to said clock oscillator for counting clock cycles;

memory means responsive to said counting means and said clock oscillator for providing control signals to said stroke initiation and completion signal means and said counting means; and logic means reponsive to said control signals from said memory means and said stroke completion signals from said initiation and completion signal means for recycling said display system.

4. A display system according to claim 2 wherein said means for establishing minimum refresh intervals for said stroke information, means for extending said minimum refresh intervals, and means for establishing fixed refresh intervals for said raster information includes:

a clock oscillator;

counting means coupled to said clock oscillator for counting clock cycles;

memory means responsive to said counting means and said clock oscillator for providing control signals to said stroke initiation and completion signal means, said raster symbol generator means, and said counting means; and logic means responsive to control signals from said memory means and said stroke completion signals from said initiation and completion signal means for recycling said display system.

5. A display according to claims 3, or 4 wherein said memory means includes a programmable read only memory.

6. A display according to claim 5 wherein said logic means includes an AND gate.

* * * * *